US010186772B2

(12) United States Patent
Lee et al.

(10) Patent No.: US 10,186,772 B2
(45) Date of Patent: Jan. 22, 2019

(54) MULTI-BRAND RADIATING ELEMENT

(71) Applicant: GAMMANU CO., LTD., Hwaseong-si, Gyeonggi-do (KR)

(72) Inventors: Su Won Lee, Osan-si (KR); Sang Geun Na, Gimje-si (KR); Do Sun Na, Osan-si (KR)

(73) Assignee: GAMMANU CO., LTD., Hwaseong-si (KR)

( * ) Notice: Subject to any disclaimer, the term of this patent is extended or adjusted under 35 U.S.C. 154(b) by 0 days.

(21) Appl. No.: 15/551,590

(22) PCT Filed: Apr. 28, 2015

(86) PCT No.: PCT/KR2015/004241

§ 371 (c)(1),
(2) Date: Aug. 16, 2017

(87) PCT Pub. No.: WO2016/133244

PCT Pub. Date: Aug. 25, 2016

(65) Prior Publication Data

US 2018/0040956 A1 Feb. 8, 2018

(30) Foreign Application Priority Data

Feb. 17, 2015 (KR) ..... 10-2015-0024235

(51) Int. Cl.
*H01Q 1/38* (2006.01)
*H01Q 19/10* (2006.01)
(Continued)

(52) U.S. Cl.
CPC ..... *H01Q 5/321* (2015.01); *H01Q 1/246* (2013.01); *H01Q 5/385* (2015.01); *H01Q 9/16* (2013.01);
(Continued)

(58) Field of Classification Search
CPC ..... H01Q 19/10; H01Q 1/38; H01Q 1/246; H01Q 21/00; H01Q 21/065; H01Q 5/321;
(Continued)

(56) References Cited

U.S. PATENT DOCUMENTS 5,220,335 A * 6/1993 Huang ..... H01Q 1/38 343/700 MS
7,015,860 B2 * 3/2006 Alsliety ..... H01Q 1/38 343/700 MS
(Continued)

FOREIGN PATENT DOCUMENTS

KR 10-2010-0109764 A 10/2010
KR 10-2011-0123715 A 11/2011
KR 10-2015-0011406 A 2/2015

*Primary Examiner* — Tho G Phan
(74) *Attorney, Agent, or Firm* — Maschoff Brennan

(57) ABSTRACT

The present invention relates to a multi-band radiating element comprising: a first high frequency radiating element formed on the upper surface of a substrate; one or more first low frequency parasitic elements formed on the upper surface of the substrate and formed at a predetermined distance from the first high frequency radiating element in the direction of the outer edge of the substrate; one or more second low frequency parasitic elements formed on the upper surface of the substrate and formed at a predetermined distance from the first high frequency radiating element in the direction of the outer edge of the substrate; a second high frequency radiating element formed on the bottom surface of the substrate; and a reflector formed at a predetermined distance from the bottom surface of the substrate.

17 Claims, 5 Drawing Sheets

(51) Int. Cl.

| | |
|---|---|
| ***H01Q 21/00*** | (2006.01) |
| ***H01Q 5/321*** | (2015.01) |
| ***H01Q 1/24*** | (2006.01) |
| ***H01Q 9/16*** | (2006.01) |
| ***H01Q 25/00*** | (2006.01) |
| ***H01Q 5/385*** | (2015.01) |
| *H01Q 21/06* | (2006.01) |

(52) U.S. Cl.
CPC ..... *H01Q 19/10* (2013.01); *H01Q 25/001* (2013.01); *H01Q 21/065* (2013.01)

(58) Field of Classification Search
CPC ..... H01Q 25/001; H01Q 5/00; H01Q 5/385; H01Q 9/16
See application file for complete search history.

(56) References Cited

U.S. PATENT DOCUMENTS

| | | | | |
|---|---|---|---|---|
| 7,423,592 | B2 * | 9/2008 | Pros | H01Q 1/243 343/700 MS |
| 8,228,254 | B2 * | 7/2012 | Foltz | H01Q 1/38 343/795 |
| 8,604,994 | B2 * | 12/2013 | Shinkai | H01Q 1/38 343/700 MS |
| 9,196,959 | B1 * | 11/2015 | Doane | H01Q 3/446 |
| 9,923,280 | B2 * | 3/2018 | Segador | H01Q 21/26 |
| 10,038,240 | B2 * | 7/2018 | Patron | H01Q 3/24 |

* cited by examiner

MULTI-BRAND RADIATING ELEMENT

TECHNICAL FIELD

The present invention relates to a multi-band radiating element, and more particularly, to a dual polarization multi-band radiating element in which a high-frequency radiating element and a low-frequency parasitic element are formed on both sides of a substrate.

BACKGROUND ART

Recently, due to development of mobile communication services, there is increasing need for a multi-band antenna that can be used in two or more frequency bands instead of only one frequency band. The same is true for repeater antennas and base station antennas as well as embedded antennas.

However, since conventional antennas are designed to be used only in a single frequency band, it is inevitable to use different antennas according to individual frequency bands in order to use the antenna in two or more frequency bands. Accordingly, to secure the length value of an antenna used in a low frequency band. In this case, however, manufacturing costs increase due to increase in size of the entire antenna resulting from the long length of the radiating element, and installers of the repeater antenna and the base station antenna should install antennas for respective frequency bands. As a result, an issue is raised in terms of installation space and installation cost increases. In addition, since the frequency band in which the antenna operates is also narrow, it is difficult to obtain satisfactory characteristics.

Accordingly, the present invention proposes a multi-band radiation device which can be used both in a high-frequency band and a low-frequency band, has a wide-band characteristic and can reduce manufacturing costs and installation costs by reducing the size of the entire antenna.

DISCLOSURE

Technical Problem

It is an object of the present invention to provide a multi-band radiating element that can be used in both high-frequency and low-frequency bands.

Another object of the present invention is to provide a multi-band radiating element having a broad frequency band in which an antenna operates and having broadband characteristics.

It is another object of the present invention to provide a multi-band radiating element with which the size of the entire antenna can be decreased and manufacturing costs and installation costs can be reduced.

It is to be understood that both the foregoing general description and the following detailed description are exemplary and explanatory and are intended to provide further explanation of the invention as claimed.

Technical Solution

In accordance with one aspect of the present invention, provided is a multi-band radiating element including a first high-frequency radiating element formed on a top surface of a substrate, one or more first low-frequency parasitic elements formed on the top surface of the substrate and spaced apart from the first high-frequency radiating element toward an outer edge of the substrate by a predetermined distance, one more second low-frequency parasitic elements formed on the top surface of the substrate and spaced apart from the first high-frequency radiating element toward the outer edge of the substrate by a predetermined distance, a second high-frequency radiating element formed on a bottom surface of the substrate, and a reflector arranged at a predetermined distance from the bottom surface of the substrate.

According to the present invention, high-frequency radiating elements that radiate different waves are provided on both sides of a substrate and a low-frequency band can be used through a parasitic element, so that the elements can be used in both high frequency and low frequency bands. It is possible to have broadband characteristics by widening the frequency band in which the antenna can operate. In addition, since parasitic elements formed on the outer edge of the substrate are used in place of long radiating elements which are individually formed for use in a low-frequency band, the size of the entire antenna may be decreased, and manufacturing costs and installation costs may be reduced.

In addition, the number of the one or more first low-frequency parasitic elements may be four, the four first low-frequency parasitic elements forming an angle of 90° with each other. The number of the one more second low-frequency parasitic elements may be four, the four second low-frequency parasitic elements forming an angle of 90° with each other.

Additionally, each of the second low-frequency parasitic elements may be formed between two adjacent first low-frequency parasitic elements forming the angle of 90° among the four first low-frequency parasitic elements. Each of the first low-frequency parasitic elements may be formed between two adjacent second low-frequency parasitic elements forming the angle of 90° among the four second low-frequency parasitic elements.

The second high-frequency radiating element may have a shape obtained when the first high-frequency radiating element is rotated 90° counterclockwise or clockwise. The reflector may include a ground component.

The multi-band radiating element may further include a third low-frequency parasitic element for supporting the substrate from the reflector. The third low-frequency parasitic element may be integrated with the reflector. The third low-frequency parasitic element may include one or more substrate supports for supporting the substrate, and one or more connectors for connecting lower ends of the substrate supports. In this case, the first low-frequency parasitic elements, the second low-frequency parasitic elements and the third low-frequency parasitic elements may be short-circuited with the ground component. The multi-band radiating element may further include one or more fourth low-frequency parasitic elements formed on the bottom surface of the substrate, the fourth low-frequency parasitic elements being spaced apart from the second high-frequency radiating element toward the outer edge of the substrate by a predetermined distance.

The first high-frequency radiating element may include a '1-1'-th line portion comprising a '1-1'-th feed and a first balun, a '1-2'-th line portion comprising a '1-2'-th feed, the '1-2'-th line portion being spaced, by a predetermined distance, apart from and parallel to the '1-1'-th line portion, a second balun formed between the '1-1'-th line portion and the '1-2'-th line portion, and a '2-1'-th feed formed between the '1-1'-th line portion and the '1-2'-th line portion and comprising one or more first vias, wherein each of the second low-frequency parasitic elements may include a '2-2' feed. The '1-1'-th feed and the '1-2'-th feed may be provided with one of feed signals having polarization characteristics of 0°, +45°, and +90°. The '2-1'-th feed and the '2-2'-th feed may be provided with one of feed signals having polarization characteristics of 0°, −45°, and −90°. The multi-band radiating element may further include a first high-frequency radiating portion formed at one end of each of the '1-1'-th line portion and the '1-2'-th line portion, and a second high-frequency radiating portion formed at an opposite end of each of the '1-1'-th line portion and the '1-2'-th line portion.

Finally, the multi-band radiating element according to an embodiment of the present invention may be implemented as a dual polarized antenna including all the technical features described above.

Advantageous Effects

According to the present invention, high-frequency radiating elements that radiate different waves are provided on both sides of a substrate and a low-frequency band can be used through a parasitic element. Thereby, both high-frequency and low-frequency bands can be used.

In addition, a frequency band from a low-frequency band to a high-frequency band in which an antenna can operate may be widened through a parasitic element. Therefore, wide band characteristics may be obtained.

In addition, since parasitic elements formed on the outer edge of the substrate are used in place of long radiating elements which are individually formed for use in a low-frequency band, the size of the entire antenna may be decreased, and manufacturing costs and installation costs may be reduced.

In addition, since the structure supporting the substrate from a reflector is used as a parasitic element of a low-frequency band and is integrated with the reflector, the manufacturing process can be shortened.

The effects of the present invention are not limited to the above-mentioned effects, and various effects may be included within the scope that is apparent to a person skilled in the art from the following description.

Figure 1:
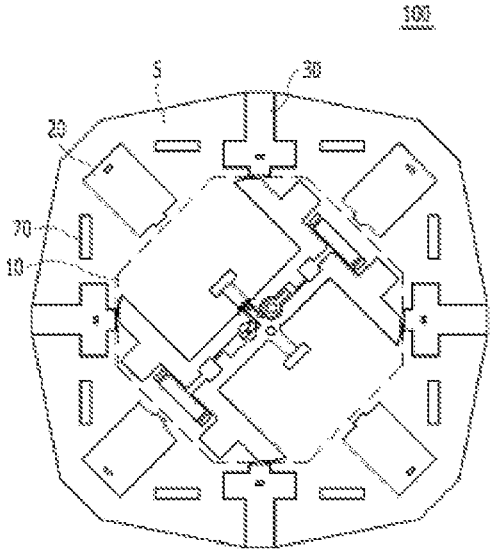
FIG. 1 is a top view of a multi-band radiating element according to an embodiment of the present invention.

Reference numerals used in the drawings are given below.

100: Multi-band radiating element
5: Substrate
6: Reflector
10: First high-frequency radiating element
20: First low-frequency parasitic element
30: Second low-frequency parasitic element
40: Second high-frequency radiating element
50: Third low-frequency parasitic element
60: Fourth low-frequency parasitic element
70: Tuning element

BEST MODE

Hereinafter, some embodiments of the present invention will be described in detail with reference to exemplary drawings. The embodiments described above are provided such that those skilled in the art can easily understand the technical idea of the present invention, and thus the present invention is not limited thereto. A detailed description of known configurations or functions incorporated herein will be omitted for clarity and brevity.

It is to be understood that both the foregoing general description and the following detailed description of the present invention are exemplary and explanatory and are intended to provide further explanation of the invention as claimed. In the drawings, the same or similar elements are denoted by the same reference numerals even if they are shown in different drawings.

In addition, the expression "comprising" is intended to merely denote that such elements exist as an "open expression", and should not be construed as excluding additional elements.

Figure 2:
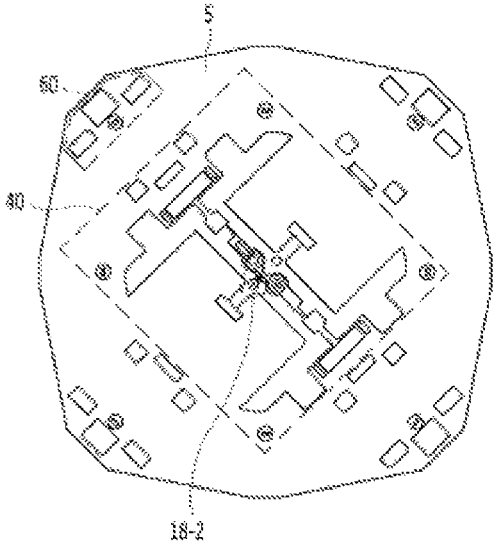
FIG. 2 is a bottom view of the multi-band radiating element according to an embodiment of the present invention.

FIG. 1 is a top view of a multi-band radiating element 100 according to an embodiment of the present invention, and FIG. 2 is a bottom view of the same.

The multi-band radiating element 100 includes a first high-frequency radiating element 10, a first low-frequency parasitic element 20, a second low-frequency parasitic element 30, a second high-frequency radiating element 40 and a reflector 6, wherein the radiating elements are formed on one surface of a substrate 5. Here, the substrate 5 refers to a typical dielectric substrate on which radiating elements can be formed, and may include typical dielectric substrates such as PCBs and FPCBs. The reflector 6 includes a ground component.

Figure 3:
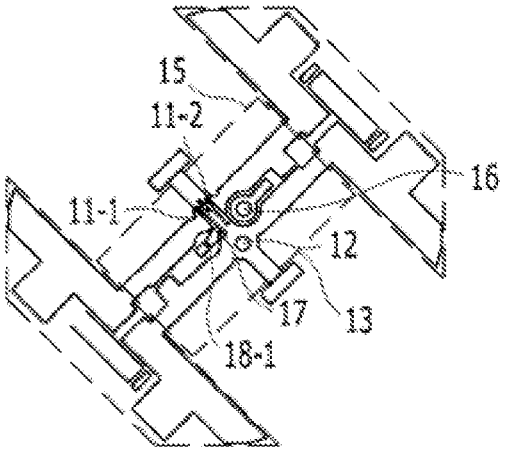
FIG. 3 is a view showing a first high-frequency radiating element.

The first high-frequency radiating element 10 is formed on the top surface of the substrate 5 to transmit and receive a feed signal in a high frequency band. Specifically, since the low-frequency parasitic elements, which will be described later, are formed on the outer edge of the substrate 5, the first high-frequency radiating element 10 is preferably formed at the center of the substrate 5. As can be seen from FIG. 3, the first high-frequency radiating element 10 includes a '1-1'-th line portion 13 including a '1-1'-th feed 11-1 and a first balun 12, to which an inner conductor of a first coaxial cable (not shown) is connected, and a '1-2'-th line portion 15 including a '1-2'-th feed 11-2 to which an outer conductor of the first coaxial cable (not shown) is connected, the '1-2'-th line portion 15 being arranged in parallel with and spaced apart from the '1-1'-th line portion 13 by a predetermined distance, a second balun 16 arranged between the '1-1'-th line portion 13 and the '1-2'-th line portion 15, a '2-1'-th feed 18-1 arranged between the '1-1'-th line portion 13 and the '1-2'-th line portion 15 and connected with an inner conductor of a second coaxial cable (not shown), at least one first via 17, a first high-frequency radiating portion 19-1, and a second high-frequency radiating portion 19-2. Hereinafter, a detailed description will be given.

The inner conductor of the first coaxial cable (not shown) is connected to the '1-1'-th feed 11-1, and the outer conductor of the first coaxial cable (not shown) is connected to the '1-2'-th feed 11-2 to input a feed signal. Specifically, a feed signal having a polarization characteristic of +45° is supplied and directly flows into the '1-1'-th line portion 13 through the '1-1'-th feed 11-1 and into the '1-2'-th line portion 15 through the '1-2'-th feed 11-2. That is, the feed signal input to the '1-1'-th feed 11-1 and the '1-2'-th feed 11-2 connected to the first coaxial cable (not shown) is provided only to the first high-frequency radiating element 10 including the '1-1'-th line portion 13 and the '1-2'-th line portion 15 which are formed on the top surface of the substrate 5. The invention is not limited to the feed signal having the +45° polarization characteristic, and feed signals having different polarization characteristics can be input. For example, any one of the feed signals having 0° and +90° polarization characteristics may be input.

The first coaxial cable (not shown) may be installed parallel to the first balun 12 at a predetermined distance from the first balun 12, and the '1-1'-th feed 11-1 and the '1-2'-th feed 11-2 may be arranged in the form of a via. More specifically, a plurality of '1-1'-th feeds 11-1 and a plurality of '1-2'-th feeds 11-2 may be provided to ensure smooth delivery of the feed signal. Preferably, the inside of the feeds may be covered with a conductive material such that the feed signal can be transmitted without interruption.

The '2-1'-th feed 18-1 is connected to the inner conductor of the second coaxial cable (not shown), and a feed signal different from the feed signal for the first-feed 11-1 is input thereto. Specifically, a feed signal having a −45° polarization characteristic is introduced and provided to the second high-frequency radiating element 40 formed on the bottom surface of the substrate 5 through the first via 17. That is, the feed signal input to the '2-1'-th feed 18-1 connected to the second coaxial cable (not shown) is provided only to the second high-frequency radiating element 40 formed on the bottom surface of the substrate 5. The invention is not limited to the feed signal having the −45° polarization characteristic, and feed signals having different polarization characteristics can be input. For example, any one of the feed signals having 0° and −90° polarization characteristics may be input. The '2-2'-th feed 18-2 connected to the outer conductor of the second coaxial cable (not shown) will be described later in the description of the second high-frequency radiating element 40.

While FIG. 1 illustrates that one '2-1'-th feed 18-1 and one first via 17 are provided, a plurality of '2-1'-th feeds 18-1 and a plurality of first vias 17 may be provided as in the case of the '1-1'-th feed 11-1 and the '1-2'-th feed 11-2, and the inside thereof may be covered with a conductive material. Further, the second coaxial cable (not shown) may be arranged parallel to and spaced apart from the second balun 16 by a predetermined distance.

The first balun 12 and the second balun 16 are arranged parallel to and spaced apart from the first coaxial cable (not shown) and the second coaxial cable (not shown) by a predetermined distance to directly connect the substrate 5 and the reflector 6. Further, the baluns cause resonance at a specific frequency by synchronizing the feed signal input by the first coaxial cable (not shown) and the feed signal input by the second coaxial cable (not shown).

Figure 4:
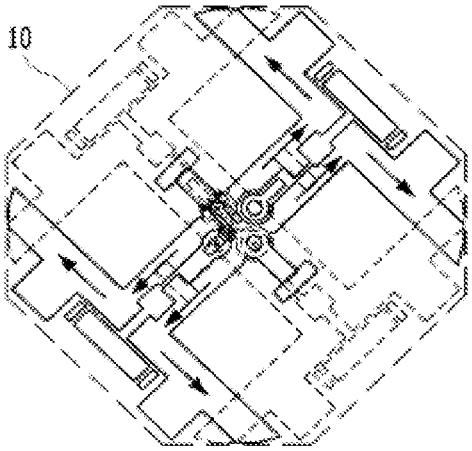
FIG. 4 shows a current flowing in the first high-frequency radiating element.

The feed signal input through the '1-1'-th feed 11-1 and the '1-2'-th feed 11-2 is provided to a first high-frequency radiating portion 19-1 formed at one end of the '1-1'-th line portion 13 and the '1-2'-th line portion 15 and a second high-frequency radiating portion 19-1 formed at the other end 19-2 through the '1-1'-th line portion 13 and the '1-2'-th line portion 15, which are arranged in parallel and spaced apart from each other by a predetermined distance. Specifically, as the feed signal having the polarization characteristic of +45° is provided, current flows through the '1-1'-th line portion 13 and the '1-2'-th line portion 15 and through the first high-frequency radiating portion 19-1 and the second high-frequency radiating portion 19-2. Thereby, the first high-frequency radiating portion 19-1 and the second high-frequency radiating portion 19-2 can radiate the feed signal of a high frequency band to the free space. The flow of this current can be seen in FIG. 4.

The first high-frequency radiating portion 19-1 and the second high-frequency radiating portion 19-2 may be formed in the shape of a dipole antenna, which is laterally symmetrical. Impedance matching may be performed by the '1-1'-th line portion 13 and the '1-2'-th line portion 15. Specifically, when a feed signal is provided to the first high-frequency radiating portion 19-1 and the second high-frequency radiating portion 19-2 through the '1-1'-th line portion 13 and the '1-2'-th line portion 15, the impedances of the '1-1'-th feed 11-1 and the '1-2'-th feed 18-1 are converted into the impedances of the first high-frequency radiating portion 19-1 and the second high-frequency radiating portion 19-2. In this case, the shapes, lengths, widths, and the like of the '1-1'-th line portion 13, the '1-2'-th line portion 15, the first high-frequency radiating portion 19-1, and the second high-frequency radiating portion 19-2 may be finely tuned to achieve accurate impedance conversion.

A second high-frequency radiating element 40 is formed on the bottom surface of the substrate 5. Specifically, the second high-frequency radiating element 40 is formed by rotating the first high-frequency radiating element 10 counterclockwise or clockwise by 90°. Like the first high-frequency radiating element 10, the second high-frequency radiating element 40 transmits and receives a feed signal in a band between 1700 MHz and 2700 MHz. Referring to FIG. 2, it can be seen that the second high-frequency radiating element 40 is formed by rotating the first high-frequency radiating element 10 of FIG. 1 counterclockwise or clockwise by 90°. That is, it is formed simply by 90° rotation, and has the line portions formed parallel to each other, high-frequency radiating portions formed at both ends of the line portions, and the baluns formed in the first high-frequency radiating element 10, and impedance matching is also performed through the line portions and the radiating portions in the same manner. However, the second high-frequency radiating element 40 is different from the first high-frequency radiating element 10 in that it has a second coaxial cable (not shown) for providing a feed signal input to the second high-frequency radiating element 40. In this regard, it has already been described above that a feed signal having a polarization characteristic of −45° is introduced through the '2-1'-th feed 18-1 connected to the inner conductor of the second coaxial cable (not shown) and provided to the second high-frequency radiating element 40 formed on the bottom surface of the substrate 5 through the first via 17. The outer conductor of the second coaxial cable (not shown), which has not been described above, is connected to the '2-2' feed 18-2 included in the second high-frequency radiating element 40. Thus, the feed signal having the −45° polarization characteristic introduced through the second coaxial cable (not shown) may be provided to the second high-frequency radiating element 40. Additionally, as described above, the invention is not limited to the feed signal having the −45° polarization characteristic, and feed signals having different polarization characteristics can be input. For example, any one of the feed signals having 0° and −90° polarization characteristics may be input.

Regarding all high-frequency radiating elements including the first high-frequency radiating element 10 and the second high-frequency radiating element 40, a feed signal having the +45° polarization characteristic is provided to the first high-frequency radiating element 10, and a feed signal having the −45° polarization characteristic is provided to the second high-frequency radiating element 40. Thereby, the multi-band radiating element of the present invention may achieve the characteristic of dual polarization. In addition, since the second high-frequency radiating element 40 is formed by rotating the first high-frequency radiating element 10 counterclockwise or clockwise by 90°, the current flowing through the first high-frequency element 10 formed on the top surface of the substrate 5 and the coupled current flowing through the second high-frequency radiating element 40 formed on the bottom surface may be mutually coupled and induced.

Figure 5:
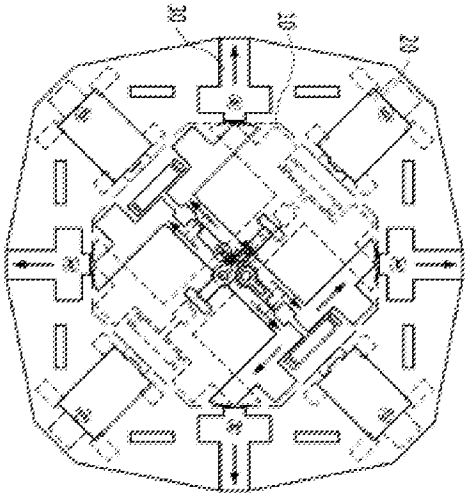
FIG. 5 shows currents flowing in the first high-frequency radiating element and a second low-frequency parasitic element.

As described above, the first high-frequency radiating element 10 and the second high-frequency radiating element 40 formed on both surfaces of the substrate 5 may be provided with feed signals having different polarization characteristics, and then radiate a feed signal of a high frequency band having a characteristic of dual polarization to the free space. In addition, a feed signal in a band of 1400 to 1700 MHz may also be transmitted and received by a part 31 of a second low-frequency parasitic element 30, which will be described later, and thus may have a wide band characteristic. A relevant flow of current can be seen in FIG. 5.

Meanwhile, the multi-band radiating element 100 according to an embodiment of the present invention may receive only one of the feed signals having different polarization characteristics, and radiate a high-frequency feed signal having a characteristic of single polarization to a free space. For example, both the first high-frequency radiating element 10 and the second high-frequency radiating element 40 may be provided with only a feed signal having a +45° polarization characteristic, or may be provided with a feed signal by forming, on the substrate 5, only one radiating element for radiating a feed signal in a high frequency band to a free space. In addition, the first and second high-frequency radiating elements 10 and 40 may be formed in various shapes different from those shown in FIGS. 1 and 2, if necessary. In addition, the multi-band radiating element 100 is capable of radiating a feed signal even in a low-frequency band, which will be described below.

One or more first low-frequency parasitic elements 20 and second low-frequency parasitic elements 30 are formed on the top surface of the substrate 5 like the first high-frequency radiating element 10, and are spaced apart from the first high-frequency radiating element 10 to the periphery of the substrate 5 by a predetermined distance. Referring to FIG. 1, four first low-frequency parasitic elements 20 and second low-frequency parasitic elements 30 are arranged on the periphery of the substrate 5 so as to surround the first high-frequency radiating element 10, which is formed at the central portion of the substrate 5. Specifically, the first low-frequency parasitic elements 20 and the second low-frequency parasitic elements 30 are arranged forming an angle of 90° therebetween. In terms of the first low-frequency parasitic elements 20, one first low-frequency parasitic element 20 is formed between two adjacent second low-frequency parasitic elements 30. In terms of the second low-frequency parasitic elements 30, one second low-frequency parasitic element 30 is formed between two first low-frequency parasitic elements 10. That is, when a second low-frequency parasitic element 30 is arranged at the 3 o'clock position as shown in FIG. 1, a first low-frequency parasitic element 20 may be arranged at the 1 o'clock position, a second low-frequency parasitic element 30 may be arranged at the 12 o'clock position, and a first low-frequency parasitic element 20 may be arranged at the 11 o'clock position. However, this is only an embodiment, and the number and positions of the first low-frequency parasitic elements 20 and the second low-frequency parasitic elements 30 may be set as needed without restriction.

Figure 6:
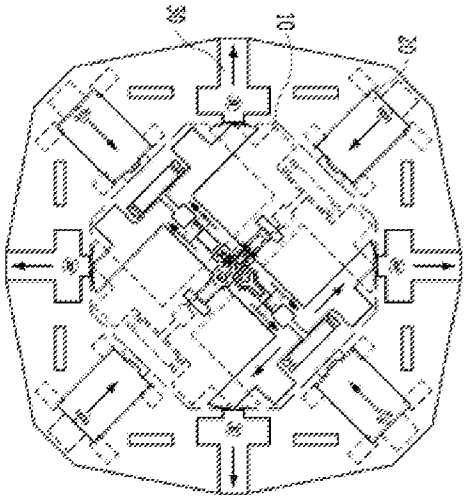
FIG. 6 shows currents flowing through the first low-frequency parasitic element and the second low-frequency parasitic element.

Both the first low-frequency parasitic element 20 and the second low-frequency parasitic element 30 may operate by coupling of a feed signal provided to the first high-frequency radiating element 10. FIG. 6 shows the shape of current flowing by being coupled to the first low-frequency parasitic elements 20 and the second low-frequency parasitic elements 30. In this case, even if a radiating element used in the low-frequency band does not secure a physical length, the same effect as that obtained by securing the length by capacitive coupling through the coupling effect may be obtained. Specifically, the first low-frequency parasitic element 20 transmits and receives a feed signal in a band of 800 to 960 MHz, and the second low-frequency parasitic element 30 may transmit and receive feed signals in a band of 698 to 800 MHz and in a band of 1400 to 1700 MHz as described. Here, both the first low-frequency parasitic elements 20 and the second low-frequency parasitic elements 30 may be finely tuned in shape, length, width, and the like to transmit and receive a feed signal in a corresponding frequency band. In the second low-frequency parasitic element 30, a '2-1'-th low-frequency parasitic element part 31 may transmit and receive feed signals in a band of 1400 to 1700 MHz, and a '2-2'-th low-frequency parasitic element part 32 may transmit and receive feed signals in a band of 698 to 800 MHz. Both the '2-1'-th low-frequency parasitic element part 31 and the '2-2'-th low-frequency parasitic element part 32 are formed on one axis of the second low-frequency parasitic element 30, which is cross-shaped. This configuration is based on the direction in which the current provided from the first high-frequency radiating element 10 flows. The other axis provides the effect of coupling with a tuning element 70, which will be described later. Forming the first low-frequency parasitic element and the second low-frequency parasitic element 30 on the outer edge of the substrate 5 is simply an embodiment. The parasitic element may be formed at any other position where they can be operatively coupled with the first high-frequency radiating element 10.

Meanwhile, a tuning element 70 may be additionally provided between the first low-frequency parasitic element 20 and the second low-frequency parasitic element 30. Referring to FIG. 1, eight tuning elements 70 are provided between the first low-frequency parasitic element 20 and the second low-frequency parasitic element 30. Here, the tuning element 70 may be fine-tuned in shape, length, width, and the like to transmit and receive a feed signal having a standing wave characteristic in the band of 1710 to 2690 MHz, and may be provided with a feed signal through the effect of coupling between the other axis of the second low-frequency parasitic element 30 and the first low-frequency parasitic element 20. The tuning element 70 shown in FIG. 1 is simply an embodiment. The position, length, width, and the like thereof may be set as needed without restriction.

According to an embodiment, the multi-band radiating element 100 includes a reflector 6 arranged at a predetermined distance from the bottom surface of the substrate 5, and may further include a third low-frequency parasitic element 50 including one or more substrate supports 51 for supporting the substrate 5 from the reflector 6 and one or more connectors 52 for connecting the lower ends of the supports, and a fourth low-frequency parasitic element 60 spaced apart from the substrate 5 by a predetermined distance toward the outer edge of the substrate 5. Hereinafter, description will be given with reference to FIGS. 2 and 7.

Figure 7:
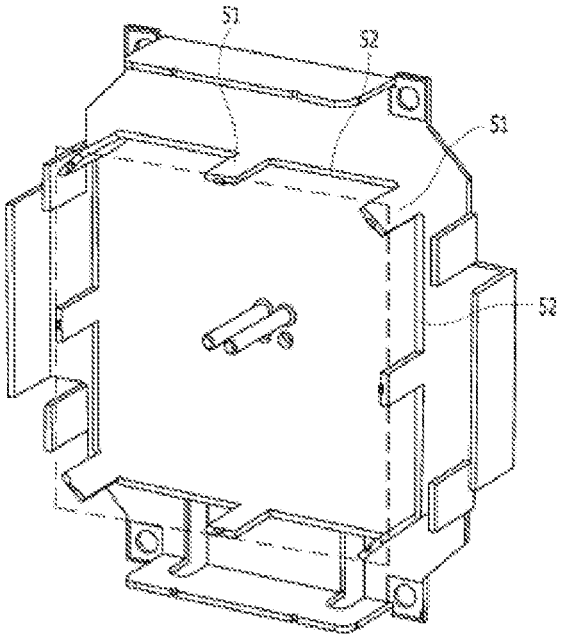
FIG. 7 is a view showing a third low-frequency parasitic element.

The third low-frequency parasitic element 50 may support the substrate 5 from the reflector 6 and may transmit and receive a feed signal in a low-frequency band, specifically in a band of 900 to 960 MHz. The third low-frequency parasitic element 50 can be seen in FIG. 7. The third low-frequency parasitic element 50 includes one or more substrate supports 51 for supporting the substrate 5, and one or more connectors 52 for connecting the lower ends of the substrate supports 51. The substrate supports 51 and the connectors 52 are all short-circuited to the ground. Here, the height, width and the like of the substrate supports 51 and the connectors 52 included in the third low-frequency parasitic element 50 may be fine-tuned to transmit and receive a feed signal in a corresponding frequency band. By simply replacing the existing structure for supporting the substrate 5 with the parasitic element, a broadband characteristic and may be obtained in a low-frequency band. In addition, the number, height, width, etc. of the substrate supports 51 and the connectors 52 shown in FIG. 7 are merely an embodiment and may be set as needed without restriction. However, due to the nature of the third low-frequency parasitic element 50, which should be provided with a feed signal through the coupling effect, at least the same number of third low-frequency parasitic elements 50 as that of the first low-frequency parasitic element 20 and the second low-frequency parasitic elements 30 is formed at positions corresponding to the positions where the first low-frequency parasitic element 20 and the second low-frequency parasitic elements 30 are formed. For example, if there are four first low-frequency parasitic elements 20 and four second low-frequency parasitic elements 30 formed as shown in FIG. 1, at least eight third low-frequency parasitic elements 50 are preferably formed as shown in FIG. 6. In addition, the third low-frequency parasitic elements 50 may be integrated with the reflector 6. In this case, a process of separately forming the third low-frequency parasitic elements 50 and the reflector 6 and attaching the same is not necessary, and therefore the entire manufacturing process may be shortened. However, it should be noted that the third low-frequency parasitic element 50 may be formed separately from the reflector 6 if necessary.

As shown in FIG. 2, one or more fourth low-frequency parasitic elements 60 are formed at a predetermined distance near the outer edge of the substrate 5 from the second high-frequency radiating element 40 formed on the bottom surface of the substrate 5, and transmit and receive a feed signal in a low-frequency band, specifically, a feed signal having a standing wave characteristic in a band of 698 to 960 MHz. Like the first low-frequency parasitic elements 20 and the second low-frequency parasitic elements 30, the fourth low-frequency parasitic elements may be arranged to form an angle of 90° therebetween. Referring to FIG. 2, the fourth low-frequency parasitic elements 60 are formed on the opposite surface of the substrate 50 with respect to the position where the first low-frequency parasitic elements 20 are formed. That is, the fourth low-frequency parasitic element 60 may receive the feed signal through the effect of coupling with the first low-frequency parasitic elements 20, thereby achieving broadband characteristics in the low-frequency band. The number and positions of the fourth low-frequency parasitic elements 60 may be set as needed without restriction. However, due to the nature of the fourth low-frequency parasitic elements 60, which are not directly supplied with a feed signal, the fourth low-frequency parasitic elements are preferably formed at positions where they can be provided with a feed signal through the effect of coupling with other elements. For example, the fourth low-frequency parasitic elements 60 may be formed not on the opposite side of the position where the first low-frequency parasitic element 20 is formed as shown in FIG. 2 but on the opposite side of the position where the second low-frequency parasitic element 30 is formed.

As described above, the first low-frequency parasitic element 20, the second low-frequency parasitic element 30, and the fourth low-frequency parasitic element 60, which are formed on the substrate 5, and the third low-frequency parasitic element 50 supporting the substrate 5 from the reflector 6 may receive a feed signal through the effect of coupling with the first high-frequency radiating element 10 and other elements and radiate a feed signal in the low-frequency band to the free space. The first to third low-frequency parasitic elements 20, 30, and 50 are short-circuited with the ground component included in the reflector 6, and may achieve the effect of securing a length even if they fail to secure a physical length for use in the low-frequency band by capacitive coupling through the effect of coupling between the first high-frequency radiating element 10 and the second high-frequency radiating element 40.

Figure 8:
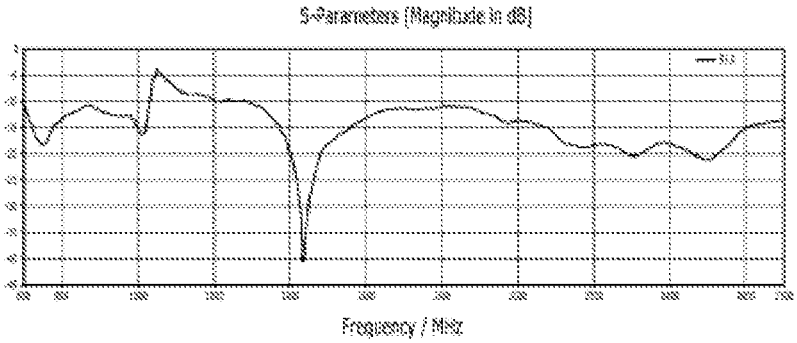
FIG. 8 is a graph depicting reflection loss of a multi-band radiating element according to an embodiment of the present invention.

FIG. 8 is a graph depicting reflection loss S11 of a multi-band radiating element 100 according to an embodiment of the present invention. Referring to FIG. 8, a band from 698 MHz to 800 MHz, a band from 800 MHz to 960 MHz band, a band from 1400 MHz to 1700 MHz, and a band from 1700 MHz to 2700 MHz where the multi-band radiating element 100 can transmit/receive signal all have a reflection loss less than or equal to −10, which is a good level of loss.

Figure 9:
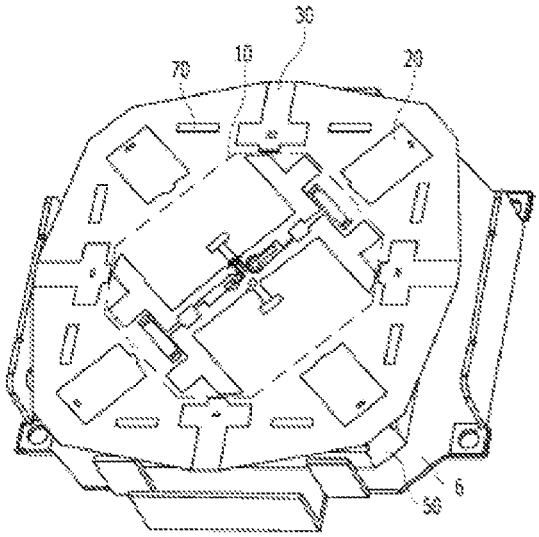
FIG. 9 is a view showing a dual polarized antenna including a multi-band radiating element according to an embodiment of the present invention.

Referring to FIG. 9, a dual polarized antenna including the multi-band radiating element 100 according to an embodiment of the present invention can be seen. The dual polarized antenna includes the multi-band radiating element 100 including a first high-frequency radiating element 10 and a second high-frequency radiating element 40, which radiate different polarized waves and are disposed on both surfaces of the substrate 5, and an additional tuning element 70. The dual polarized antenna is allowed to use even the low-frequency band through the first to fourth parasitic elements 20, 30, 50, and 60, and thus can be used in both the high frequency band and the low frequency band. Further, since the tuning element 70 and the first to fourth parasitic elements 20, 30, 50, and 60 are provided with a feed signal through the coupling effect, the frequency band in which the antenna operates by capacitive coupling may be a broad band. In addition, a long radiating element for use in the low-frequency band is not additionally formed. Rather, the first and second parasitic elements 20 and 30 are formed on the outer edge of the top surface of the substrate 5, which is a limited space, the fourth element 60 is formed on the outer edge of the bottom surface, and the structure for supporting the substrate 5 from the reflector 6 is integrated with the reflector 6 as the third parasitic element 50. Therefore, a compact antenna and a shortened manufacturing process may be obtained, and manufacturing and installation costs may be reduced.

The embodiments of the present invention described above are disclosed for the purpose of illustration, and the present invention is not limited thereto. It will be apparent to those skilled in the art that various modifications and variations can be made in the present invention without departing from the spirit and scope of the invention.

The invention claimed is:

1. A multi-band radiating element comprising:

a first high-frequency radiating element formed on a top surface of a substrate;

one or more first low-frequency parasitic elements formed on the top surface of the substrate and spaced apart from the first high-frequency radiating element toward an outer edge of the substrate by a predetermined distance;

one or more second low-frequency parasitic elements formed on the top surface of the substrate and spaced apart from the first high-frequency radiating element toward the outer edge of the substrate by a predetermined distance;

a second high-frequency radiating element formed on a bottom surface of the substrate; and a reflector arranged at a predetermined distance from the bottom surface of the substrate.

2. The multi-band radiating element according to claim 1, wherein the number of the one or more first low-frequency parasitic elements is four, the four first low-frequency parasitic elements forming an angle of 90° with each other.

3. The multi-band radiating element according to claim 2, wherein each of the second low-frequency parasitic elements is formed between two adjacent first low-frequency parasitic elements forming the angle of 90° among the four first low-frequency parasitic elements.

4. The multi-band radiating element according to claim 1, wherein the number of the one or more second low-frequency parasitic elements is four, the four second low-frequency parasitic elements forming an angle of 90° with each other.

5. The multi-band radiating element according to claim 4, wherein each of the first low-frequency parasitic elements is formed between two adjacent second low-frequency parasitic elements forming the angle of 90° among the four second low-frequency parasitic elements.

6. The multi-band radiating element according to claim 1, wherein the second high-frequency radiating element has a shape obtained when the first high-frequency radiating element is rotated 90° counterclockwise or clockwise.

7. The multi-band radiating element according to claim 1, wherein the reflector comprises a ground component.

8. The multi-band radiating element according to claim 7, further comprising:

a third low-frequency parasitic element for supporting the substrate from the reflector.

9. The multi-band radiating element according to claim 8, wherein the third low-frequency parasitic element is integrated with the reflector.

10. The multi-band radiating element according to claim 8, wherein the third low-frequency parasitic element comprises:

one or more substrate supports for supporting the substrate; and one or more connectors for connecting lower ends of the substrate supports.

11. The multi-band radiating element according to claim 8, wherein the first low-frequency parasitic elements, the second low-frequency parasitic elements and the third low-frequency parasitic elements are short-circuited with the ground component.

12. The multi-band radiating element according to claim 1, further comprising:

one or more fourth low-frequency parasitic elements formed on the bottom surface of the substrate, the fourth low-frequency parasitic elements being spaced apart from the second high-frequency radiating element toward the outer edge of the substrate by a predetermined distance.

13. The multi-band radiating element according to claim 1, wherein the first high-frequency radiating element comprises:

a '1-1'-th line portion comprising a '1-1'-th feed and a first balun;

a '1-2'-th line portion comprising a '1-2'-th feed, the '1-2'-th line portion being spaced, by a predetermined distance, apart from and parallel to the '1-1'-th line portion;

a second balun formed between the '1-1'-th line portion and the '1-2'-th line portion; and a '2-1'-th feed formed between the '1-1'-th line portion and the '1-2'-th line portion and comprising one or more first vias, wherein each of the second high-frequency radiating elements comprises a '2-2' feed.

14. The multi-band radiating element according to claim 13, wherein the '1-1'-th feed and the '1-2'-th feed are provided with one of feed signals having polarization characteristics of 0°, +45°, and +90°.

15. The multi-band radiating element according to claim 13, wherein the '2-1'-th feed and the '2-2'-th feed are provided with one of feed signals having polarization characteristics of 0°, −45°, and −90°.

16. The multi-band radiating element according to claim 13, further comprising:

a first high-frequency radiating portion formed at one end of each of the '1-1'-th line portion and the '1-2'-th line portion; and a second high-frequency radiating portion formed at an opposite end of each of the '1-1'-th line portion and the '1-2'-th line portion.

17. A dual polarized antenna comprising the multi-band radiating element according to claim 1.

* * * * *